United States Patent [19]

Quitmann

[11] Patent Number: 4,586,615

[45] Date of Patent: May 6, 1986

[54] HOLDER

[75] Inventor: Clive E. O. Quitmann, Hever, Near Edenbridge, England

[73] Assignee: Spiralux Limited, Kent, England

[21] Appl. No.: 587,209

[22] Filed: Mar. 7, 1984

[30] Foreign Application Priority Data

Mar. 9, 1983 [GB] United Kingdom ..... 8306442

[51] Int. Cl.[4] ..... A47F 5/08

[52] U.S. Cl. ..... 211/70.6; 206/349; 206/372; 211/89; 220/23.4

[58] Field of Search ..... 211/70.6, 13, 89, 60.1, 211/87, 59.1, 57.1, 70.7; 248/316.7, 316.1; 206/364, 349, 365, 372, 373, 564, 565, 306; 220/23.4

[56] References Cited

U.S. PATENT DOCUMENTS

| | | | |
|---|---|---|---|
| 2,883,061 | 4/1959 | Moone | 211/13 |
| 4,402,423 | 9/1983 | Skowronski et al. | 220/23.4 X |
| 4,410,095 | 10/1983 | Dembicks | 211/70.6 |

FOREIGN PATENT DOCUMENTS

| | | | |
|---|---|---|---|
| 2435010 | 2/1976 | Fed. Rep. of Germany | 206/349 |
| 2607941 | 9/1977 | Fed. Rep. of Germany . | |
| 443994 | 3/1936 | United Kingdom . | |
| 1508962 | 4/1978 | United Kingdom . | |

*Primary Examiner*—Robert W. Gibson, Jr.
*Attorney, Agent, or Firm*—Ronald P. Kananen

[57] ABSTRACT

A holder for an article can be used on a display device at the point of sale, and as part of a rack of similar holders by the user. The holder comprises a base plate, holding means for detachably holding the article, first mounting means, and second mounting means. The holding means is provided on one side of the base plate. The first mounting means is provided for mounting the holder on a display device, and the second mounting means is provided for fixing the holder to a wall with the other side of the base plate in contact with the wall. The base plate is generally rectangular in configuration, and the edges of at least one pair of its opposed edges are provided with complementarily-shaped projections, whereby the holder can be joined to a similar holder by engaging one of said projections with the complementarily-shaped projection of the other holder.

15 Claims, 7 Drawing Figures

HOLDER

BACKGROUND TO THE INVENTION

This invention relates to a holder for an aticle such as a tool; and in particular to a tool holder that can be used for display purposes in a shop, and for mounting the tool on, for example, the wall of a workshop or garage.

SUMMARY OF THE INVENTION

The present invention provides a holder for an article, the holder comprising a base plate, holding means for detachably holding the article, first mounting means, and second mounting means, the holding means being provided on one side of the base plate, the first mounting means being provided for mounting the holder on a display device, and the second mounting means being provided for fixing the holder to a support member with the other side of the base plate in contact with said support member, wherein the base plate is generally rectangular in configuration, and wherein the edges of at least one pair of opposed edges of the base plate are provided with complementarily-shaped projections, whereby the holder can be joined to a similar holder by engaging one of said projections with the complementarily-shaped projection of the other holder.

Advantageously, one of said projections is a flange extending at right-angles to the base plate and away from said one side thereof, the other of said projections being a channel-shaped member. Preferably, the projections are such that the flange of one holder is a friction fit in the channel-shaped member of another similar holder. Conveniently, the flange is formed with at least one tab, and the channel-shaped member is formed with at least one complementary aperture, the or each tab being a snap fit within a respective aperture of another similar holder. Preferably, the edges of both pairs of opposed edges are provided with complementarily-shaped projections. Thus, when a plurality of holders are mounted on, for example, a wall, the holders can be clipped together side-by-side and/or end-to-end in a neat rectangular array.

In a preferred embodiment, the holding means includes a pair of opposed flange members fixed to, and extending outwardly from, the base plate, the flange members being made of resilient material, and being inclined towards one another so that, in use, they resiliently grip a portion of the article positioned therebetween.

Advantageously, the holder further comprises at least one support provided on said one side of the base plate, the or each support being fixed to, and extending outwardly from, the base plate, and being engageable with part of the article to support the article. Preferably, there are at least two supports, one of which is a C-shaped member and another of which is a grooved member. When the holder is positioned vertically, the C-shaped member is such as to support a part of the article (for example, where the article is a screwdriver, the end portion of the handle from which the blade emerges).

The first mounting means may be an elongate slot formed in the base plate adjacent to one end thereof, the slot being adapted to pass over a rod-like member of a display device. Advantageously, the slot is formed with an enlarged circular portion at its centre, said enlarged circular portion being sized to form a loose fit around said rod-like member.

Preferably, the second mounting means is constituted by two aperatures in the base plate, each aperture being adpated to receive a screwthreaded member used to fix the holder to said support member.

In a preferred embodiment, the holder further comprises a wall member fixed to, and extending generally at right-angles to, said one side of the base plate adjacent to one end thereof, and a pair of grooved members fixed to, and extending substantially at right-angles to, said one side of the base plate adjacent to the other end thereof, the arrangement being such that the free end of the wall member of the holder is a friction fit within the grooved members of a similar holder, whereby the holder can be clipped to another similar holder with the base plates of the two holders in spaced parallel positions. This feature, together with the feature enabling the holders to be clipped together side-by-side, enables the holders to be clipped together to form a firm stack. Consequently, these holders are easy to package together.

Preferably, the holder is a one-piece injection-moulded member made of polystyrene or other polymeric material. The holder is, therefore, cheap and easy to manufacture.

BRIEF DESCRIPTION OF THE DRAWINGS

Two forms of tool holder, each of which is constructed in accordance with the invention, will now be described, by way of example, with reference to the accompanying drawings, in which.

DESCRIPTION OF PREFERRED EMBODIMENTS

Figure 1:
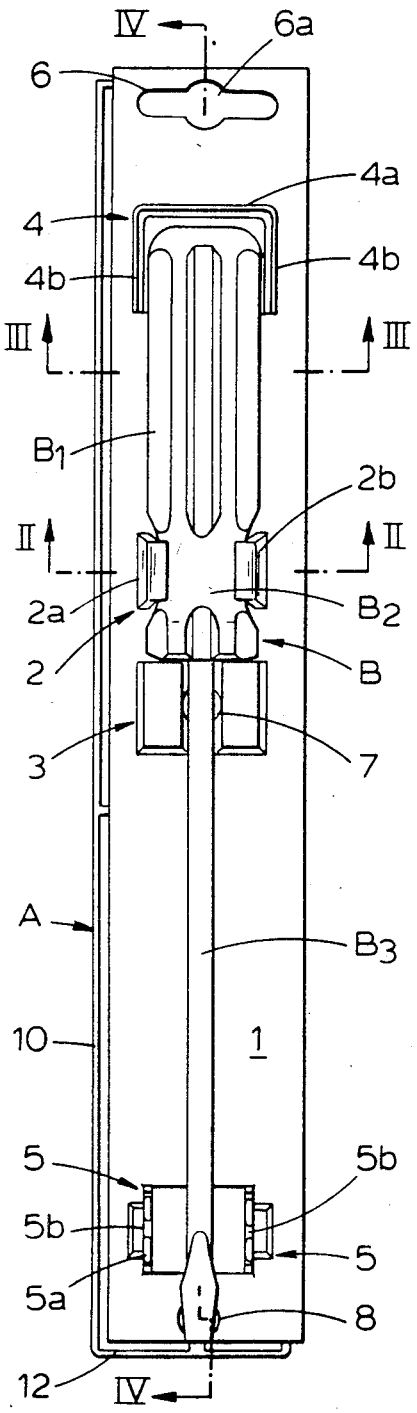
FIG. 1 is a plan view of the first form of holder and a screwdriver held therein.
Figure 4:
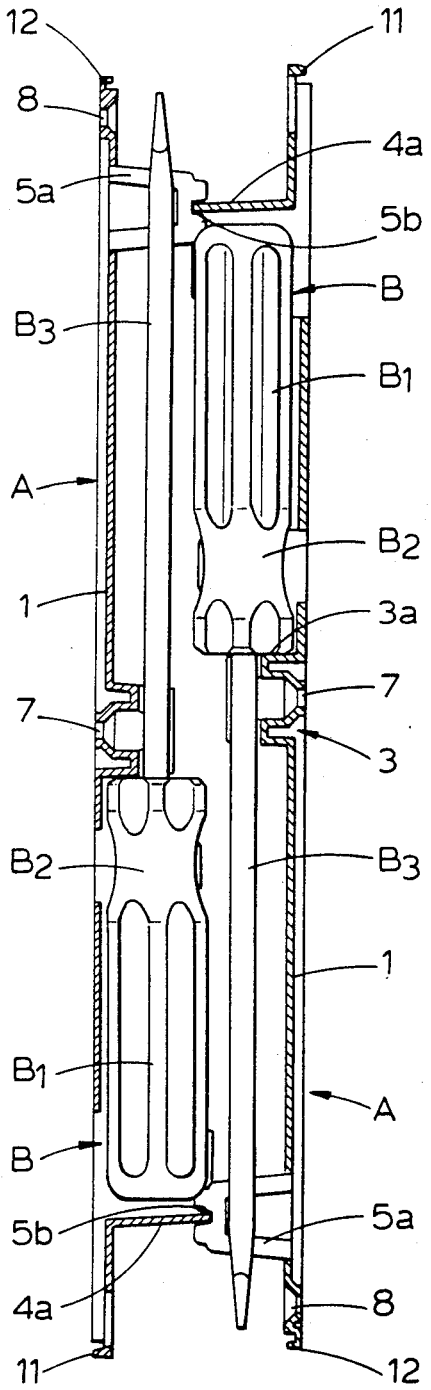
FIG. 4 is a cross-section taken on the line IV—IV of FIG. 1, this figure also showing a similar holder clipped to the top of the holder of FIG. 1.

Referring to the drawings, FIG. 1 shows a holder A for a screwdriver B. The holder A is an injection-moulded one-piece member made of polystyrene. The holder A has a base plate 1 provided with four upwardly-projecting members 2, 3, 4 and 5. The members 2 and 3 are provided for holding the screwdriver in position within the holder A, and the members 4 and 5 are provided for facilitating stacking of the holder against a similar holder (as will be explained below). The member 2 (see FIG. 2) is constituted by a pair of longitudinally-extending wall members 2*a* and 2*b*, these members being inclined towards one another in such a manner that, in use, they resiliently grip a necked portion $B_2$ of the screwdriver handle $B_1$. The member 3 is a tunnel-shaped member through which the blade $B_3$ of the screwdriver B can pass. As shown in FIG. 4, the end face 3*a* of the member 3 abuts the adjacent end face of the screwdriver handle $B_1$. The members 2 and 3 are, therefore, effective to hold the screwdriver B firmly on the holder A.

The member 4 is constituted by a generally upright wall of C-shaped cross-section, this member being adapted to receive loosely the free end portion of the screwdriver handle $B_1$. Thus, the member 4 has a transverse wall member 4*a*, and a pair of longitudinally-extending wall members 4*b*. The member 5 is constituted by a pair of laterally-spaced side members 5*a*, whose upper free ends are formed with transverse grooves 5*b* (see FIG. 4).

The base plate 1 of the holder A is provided with an elongate aperture 6 adjacent to the end thereof nearest the member 4. The aperture 6 is formed with an enlarged circular portion 6*a* at its centre, this enlarged portion being used to hang the holder A on a generally horizontal cylindrical rod for display purposes in, for example, a shop. The base plate 1 is also formed with two holes 7 and 8, these holes being provided for receiving screws (not shown) by means of which the holder A can be screwed to the wall of, for example, a garage of the purchaser.

Figure 3:
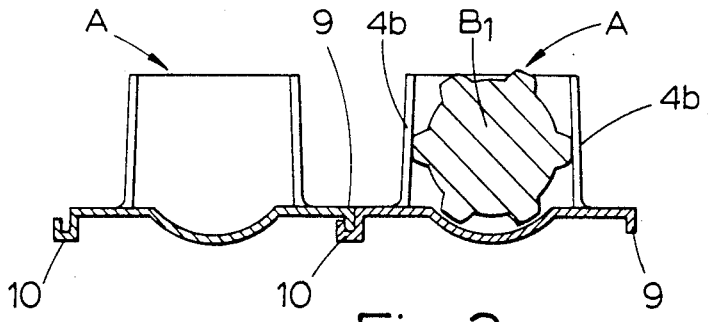
FIG. 3 is a cross-section taken on the line III—III of FIG. 1, this figure also showing a similar holder clipped to the side of the holder of FIG. 1.
Figure 2:
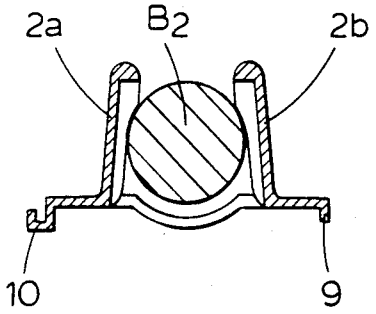
FIG. 2 is a cross-section taken on the line II—II of FIG. 1.

As shown best in FIGS. 2 and 3, one longitudinal edge of the base plate 1 is provided with a flange 9 which extends downwardly therefrom, and at right-angles thereto. The other longitudinal edge of the base plate 1 is formed with a channel-shaped member 10. As shown in FIG. 3, the flange 9 of one holder A is arranged to be a friction fit within the channel-shaped member 10 of a similar holder. Similarly, the end edge of the base plate 1 adjacent to the aperture 6 is provided with a flange 11 which extends downwardly therefrom, and at right-angles thereto. The other end edge of the base plate 1 is formed with a channel-shaped member 12. The flange 11 of one holder is arranged to be a friction fit within the channel-shaped member of a similar holder. Thus, when fastening a plurality of holders onto a wall, the holders can be clipped together side-by-side and end-to-end to define a neat rack of tools.

The grooves 5*b* of the member 5 are shaped to receive, with a friction fit, the free end of the transverse wall member 4*a* of the member 4 of a similar holder positioned upside-down and reversed end-to-end with respect thereto. As shown in FIG. 4, the member 5 of each holder engages with the transverse wall member 4*a* of the other holder. Thus, by clipping together several holders along their longitudinal edges, (in the manner described above with reference to FIGS. 2 and 3), and by positioning a further row of holders on top of the first row (in the manner described above with reference to FIG. 4), a compact pack of, for example, 6 or 12 holders and screwdrivers can be assembled. Moreover, the holders of such a pack are clipped together, so that the pack tends to hold together.

Figure 6:
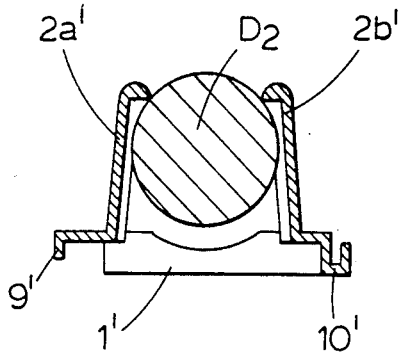
FIG. 6 is a cross-section taken on the line VI—VI of FIG. 5.
Figure 7:
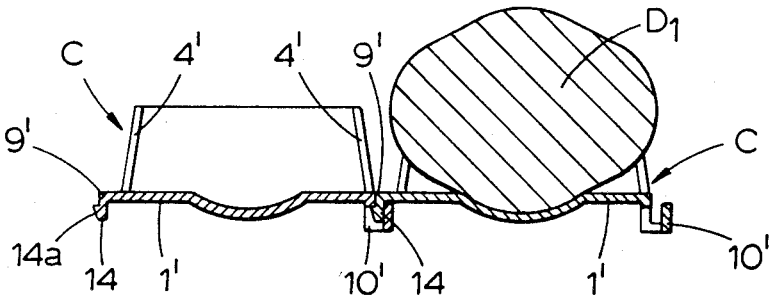
FIG. 7 is a cross-section taken on the line VII—VII of FIG. 5, this figure also showing a similar holder clipped to the side of the holder of FIG. 5.
Figure 5:
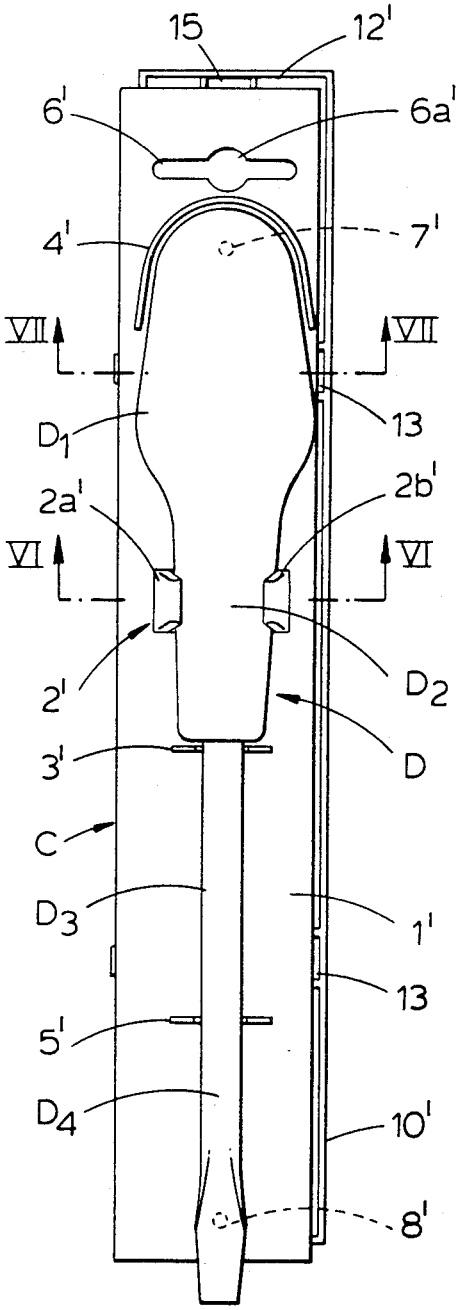
FIG. 5 is a plan view of the second form of holder and a screwdriver held therein.

FIGS. 5 to 7 show a modified form of holder C for a screwdriver D. The holder C is very similar to the holder A, and so like (but primed) reference numerals will be used for like parts. As with the holder A, the holder C is an injection-moulded one-piece member made of polystyrene. The holder C has a base plate 1′ provided with four-upwardly projecting members 2′, 3′, 4′ and 5′, these members being provided for holding the screwdriver D in position within the holder C. The member 2′ (see FIG. 6) is constituted by a pair of longitudinally-extending wall members 2*a*′ and 2*b*′, these members being inclined towards one another in such a manner that, in use, they resiliently grip a portion $D_2$ of the screwdriver handle $D_1$. The member 3′ is a grooved member against which the blade $D_3$ of the screwdriver D can rest. As shown in FIG. 5, the member 3′ abuts the adjacent end face of the screwdriver handle $D_1$. The members 2′ and 3′ are, therefore, effective to hold the screwdriver D firmly on the holder C.

The member 4′ is constituted by a generally upright wall of C-shaped cross-section, this member being adapted to receive loosely the free end portion of the screwdriver handle $D_1$. The member 5′ is a grooved member, against which rests the end portion $D_4$ of the screwdriver blade $D_3$.

The base plate 1′ of the holder C is provided with an elongate aperture 6′ adjacent to the end thereof nearest the member 4′. The aperture 6′ is formed with an enlarged circular portion 6*a*′ at its centre, this enlarged portion being used to hang the holder C on a generally horizontal cylindrical rod for display purposes in, for example, a shop. The base plate 1′ is also formed with two holes 7′ and 8′, these holes being provided for receiving screws (not shown) by means of which the holder C can be screwed to the wall of, for example, a garage of the purchaser.

As shown best in FIGS. 6 and 7, one longitudinal edge of the base plate 1′ is provided with a flange 9′ which extends downwardly therefrom, and at right-angles thereto. The other longitudinal edge of the base plate 1′ is formed with a channel-shaped member 10′. As shown in FIG. 5, the channel-shaped member 10′ is formed with a pair of apertures 13. Similarly, the flange 9′ is formed with two pairs of nicks (not shown) which define tabs 14 (one of which is shown in FIG. 7). The tabs 14 are formed with inclined ramp surfaces 14*a*. As shown in FIG. 7, the flange 9′ of one holder C is arranged to be a friction fit within the channel-shaped member 10′ of a similar holder; and the tabs 14 of one holder are arranged to snap into the apertures 13 of the other holder. Similarly, the end edge of the base plate 1′ adjacent to the aperture 6′ is provided with a flange 11′ which extends downwardly therefrom, and at right-angles thereto. The other end edge of the base plate 1′ is formed with a channel-shaped member 12′. The channel-shaped member 12′ is provided with an aperture 15, and the flange 11′ is provided with a tab 16 having an inclined ramp surface 16*a*. The flange 11′ of one holder C is arranged to be a friction fit within the channel-shaped member 12′ of a similar holder; and the tab 16 of one holder if arranged to snap into the aperture 15 of the other holder. Thus, when fastening a plurality of holders onto a wall, the holders can be clipped together to define a neat rack of tools.

It will be apparent that each of the holders A & C described above has the advantage of being a multi-purpose device. In particular, each holder can be used both as a point-of-sale display device, and as a device for mounting an article on a wall. Moreover, the holders can clip together both side-by-side and end-to-end, so that they can be combined to form a "unitary" rack for mounting different sized screwdrivers (or other tools).

The types of holder A and C described above are very versatile. Thus, by varying the positions and numbers of the members 2 or 2′, 3 or 3′, 4 or 4′ and 5 or 5′ on the base plate 1 or 1′, the holder A or C can be adapted to hold any one of a given range of screwdrivers. Moreover, by increasing the width and/or the length of the base plate 1 or 1′, the range of screwdrivers which can be accommodated can be increased substantially. In particular, a modified form of holder could be produced by doubling the width of the base plate 1 or 1', or by doubling the length of the base plate. By appropriately re-positioning and/or re-sizing the members 2 or 2', 3 or 3', 4 or 4' and 5 or 5', the modified holder could be adapted to hold thicker and longer srewdrivers respectively. Moreover, by doubling up the width and length of the base plates, the purchaser of such holders could fasten them to his garage wall together with standard holders A or C to define a neat and regular rack of tools. Obviously, the holders could also be modified by increasing the width and/or length of the base plates by three or more times, thereby further increasing the range of screwdrivers which could be held, whilst still permitting the holders to be clipped together to define a neat rack of tools. It would also be possible to reduce the width and/or length of the base plate by, say, one half. In this case, the member 3 or 3' or the member 5 or 5' may be dispensed with.

It will also be apparent that, by modifying the numbers, positions and formations of the members 2 or 2', 3 or 3', 4 or 4' and 5 or 5', the holder A or C could be adapted to hold tools other than screwdrivers. For example, if the holder was adapted to hold a tool such as a snap-rivetter, the moulding could be modified to provide a recess for accommodating a number of rivets for use with the rivetter. This type of holder could also be used to hold articles such as small toys. In this case, the holders could be fastened to, say a child's bedroom wall, in a neat rack which could hold the toys when not being used.

It will be apparent that the holder described above could be modified in a number of ways. For example, to discourage pilfering in shops, the screwdrivers (or other tools) could additionally be retained in position on the holders by means such as ties or clips. Such additional retention means would enable a prospective purchaser to touch and feel the quality of the tools, but would reduce the chance of theft. Moreover, where the article to be held is quite large, it is possible to provide two or more of the members 2 or 2', as this results in a more secure attachment. Where the holder A or C is small, it is possible to fix the base plate, 1 or 1' thereof to a wall using only one screw. In this case, therefore, only one of the apertures 7 or 7', 8 or 8' is necessary.

I claim:

1. A holder for an article, the holder comprising a base plate, holding means for detachably holding the article, first mounting means, and second mounting means, the holding means being on one side of the base plate, the first mounting means being for mounting the holder on a display device, and the second mounting means being for fixing the holder to a support member with the other side of the base plate in contact with said support member, wherein the base plate is generally rectangular in configuration, and wherein the edges of at least one pair of opposed edges of the base plate are provided with complementarily-shaped projections, wherein one of said projection is a flange extending at right-angles to the base plate and away from said one side thereof, the other of said projections being channel-shaped members, whereby the holder can be joined to a similar holder by engaging one of said projections with the complementarily-shaped projection of the other holder.

2. A holder according to claim 1, wherein the projections are such that the flange of one holder is a friction fit in the channel-shaped member of another similar holder.

3. A holder according to claim 1, wherein the flange is formed with at least one tab, and the channel-shaped member is formed with at least one complementary aperture, said at least one tab being a snap fit within a respective aperture of another similar holder.

4. A holder according to claim 3, wherein the edges of both pairs of opposed edges are provided with complementarily-shaped projections.

5. A holder according to claim 1, wherein the holding means includes a pair of opposed flange members fixed to, and extending outwardly from, the base plate, the flange members being made of resilient material, and being inclined towards one another so that they resiliently grip a portion of the article positioned therebetween.

6. A holder according to claim 1, further comprising at least one support provided on said one side of the base plate, said at least one support being fixed to, and extending outwardly from, the base plate, and being engageable with part of the article to support the article.

7. A holder according to claim 6, wherein there are at least two supports, one of which is a C-shaped member and another of which is a grooved member.

8. A holder according to claim 1, wherein the first mounting means is an elongate slot formed in the base plate adjacent to one end thereof, the slot being adapted to pass over a rod-like member of a display device.

9. A holder according to claim 8, wherein the slot is formed with an enlarged circular portion at its centre, said enlarged circular portion being sized to form a loose fit around said rod-like member.

10. A holder according to claim 1, wherein the second mounting means comprises two apertures in the base plate, each aperture being adapted to receive a screw-threaded member to fix the holder to said support member.

11. A holder according to claim 1, further comprising a wall member fixed to, and extending generally at right-angles to, said one side of the base plate adjacent to one end thereof, and a pair of grooved members fixed to, and extending substantially at right-angles to, said one side of the base plate adjacent to the other end thereof, the arrangement being such that the free end of the wall member of the holder is a friction fit within the grooved members of a similar holder, whereby the holder can be clipped to another similar holder with the base plates of the two holders in spaced parallel positions.

12. A holder according to claim 1, wherein the holder is a one-piece injection-moulded member made of polystyrene.

13. A holder for an article, the holder comprising a base plate, holding means for detachably holding the article, first mounting means, and second mounting means, the holding means being on one side of the base plate, the first mounting means being for mounting the holder on a display device, and the second mounting means being for fixing the holder to a support member with the other side of the base plate in contact with said support member, the base plate being generally rectangular in configuration, and the edges of both pairs of opposed edges of the base plate being provided with complementarily-shaped projections, whereby the holder can be joined to a similar holder by engaging one of said projections with the complementarily-shaped projection of the other holder, wherein one of said projections of each pair of opposed edges is a flange extending at right-angles to the base plate and away from said one side thereof, the other of said projections of each pair of opposed edges being a channel-shaped member, each flange being formed with at least one tab, and each channel-shaped member being formed with at least one complementary aperture, each tab being a snap fit within a respective aperture of another similar holder, wherein the holding means includes a pair of opposed flange members fixed to, and extending outwardly from, the base plate, the flange members being made of resilient material, and being inclined towards one another so that they resiliently grip a portion of the article positioned therebetween, wherein the first mounting means is an elongate slot formed in the base plate adjacent to one end thereof, the slot being adapted to pass over a rod-like member of a display device, and being formed with an enlarged circular portion at its centre, said enlarged circular portion being sized to form a loose fit around said rod-like member, wherein the second mounting means comprises two apertures in the base plate, each aperture being adapted to receive a screw-threaded member used to fix the holder to said support member, and wherein the holder is a one-piece injection-moulded member made of polystyrene.

14. A holder for an article, the holder comprising:

a base plate defined by a surface and at least two opposed edges;

holding means structurally adapted for detachably holding an article, said holding means being located on said surface of said base plate;

first mounting means structurally adapted for mounting the holder on a display device;

second mounting means structurally adapted for fixing the holder to a support member so that second surface opposite to said surface on which said article is located is in contact with said support member; and said opposed edges of said base plate defining complementarily-shaped projections structurally related so that a holder is joined to an adjacent holder by engaging one of said complementarily-shaped projections on said holder with a complementary one of said complementary-shaped projections lcoated at an adjacent side of said adjacent holder, whereby a pair of separate holders are interlocked by said complementary projections at adjacent sides of said pair of holders.

15. A holder for an article, the holder comprising a base plate, holding means for detachably holding the article, first mounting means, and second mounting means, the holding means being on one side of the base plate, the first mounting means being for mounting the holder on a display device, and the second mounting means being for fixing the holder to a support member with the other side of the base plate in contact with said support member, wherein the base plate is generally rectangular in configuration, and wherein the edges of at least one pair of opposed edges of the base plate are provided with complementarily-shaped projections, whereby the holder can be joined to a similar holder by engaging one of said projections with the complementarily-shaped projection of the other holder, which holder further comprises at least one support provided on said one side of the base plate, said at least one support being fixed to, and extending outwardly from the base plate, and being engageable with part of the article to support the article, wherein there are at least two supports, one of which is a C-shaped member and the other of which is a grooved member.

* * * * *